US007799262B1

(12) United States Patent
Kim

(10) Patent No.: US 7,799,262 B1
(45) Date of Patent: Sep. 21, 2010

(54) METHOD OF MANUFACTURING A CONTINUOUS FILAMENT BY ELECTROSPINNING

(75) Inventor: Hak-Yong Kim, Jeonju-si (KR)

(73) Assignee: Industrial Cooperation Foundation Chonbuk National University, Jeonju-Si (KR)

( * ) Notice: Subject to any disclaimer, the term of this patent is extended or adjusted under 35 U.S.C. 154(b) by 188 days.

(21) Appl. No.: 11/916,639

(22) PCT Filed: Mar. 16, 2005

(86) PCT No.: PCT/KR2006/000963

§ 371 (c)(1),
(2), (4) Date: Dec. 5, 2007

(87) PCT Pub. No.: WO2006/129910

PCT Pub. Date: Dec. 7, 2006

(30) Foreign Application Priority Data

May 2, 2005 (KR) ..... 10-2005-0036733
May 10, 2005 (KR) ..... 10-2005-0038894

(51) Int. Cl.
*D01D 5/16* (2006.01)
*D01D 10/06* (2006.01)
*D06M 10/00* (2006.01)

(52) U.S. Cl. ..... 264/465; 264/210.8; 264/211.12; 264/211.17; 264/234

(58) Field of Classification Search ..... 264/210.8, 264/211.12, 211.14, 211.17, 234, 465
See application file for complete search history.

(56) References Cited

U.S. PATENT DOCUMENTS

| | | | | |
|---|---|---|---|---|
| 4,044,404 | A | 8/1977 | Martin et al. | |
| 5,045,248 | A | 9/1991 | Satterfield et al. | |
| 6,110,590 | A | 8/2000 | Zarkoob et al. | |
| 2002/0089094 | A1* | 7/2002 | Kleinmeyer et al. | 264/465 |
| 2002/0090725 | A1* | 7/2002 | Simpson et al. | 435/402 |
| 2005/0253305 | A1* | 11/2005 | Kim et al. | 264/465 |
| 2008/0241538 | A1* | 10/2008 | Lee et al. | 264/465 X |

FOREIGN PATENT DOCUMENTS

KR 10-2004-0076006 A 8/2004

* cited by examiner

*Primary Examiner*—Leo B Tentoni
(74) *Attorney, Agent, or Firm*—Birch, Stewart, Kolasch & Birch, LLP

(57) ABSTRACT

The invention is directed to a method of making continuous filament by electrospinning, wherein electrospun nanofibers are collected on a multi-layer type collector consisting of two or more, rotating disk-shaped conductive materials by electrospinning a polymer dope onto the multi-layer collector with a high voltage applied thereto and which rotates at a rotational linear velocity of 5 m/sec or more, through nozzles having a high voltage applied thereto, and then collecting the nanofibers on the collector in the form of a continuous filament by the use of a collecting roller, and conveying the nanofibers to a canvas through a traverse, or dried, drawn, and wound consecutively.

25 Claims, 5 Drawing Sheets

METHOD OF MANUFACTURING A CONTINUOUS FILAMENT BY ELECTROSPINNING

TECHNICAL FIELD

The present invention relates to a method of manufacturing a continuous filament or yarn (hereinafter, commonly referred to as a "filament") by an electrospinning method and a continuous filament manufactured thereby, and more particularly, to a method of manufacturing a continuous filament which is superior in physical properties and composed of a nano fiber by a continuous procedure by continuously producing a filament superior in drawing properties because of nano fibers well arranged in the filament axis direction, and then putting them in canvas through a traverse movement or continuously drying, drawing, and winding them.

In the present invention, the nano fiber refers to a fiber having a fiber diameter 1,000 nm or less, and more preferably, 500 nm or less.

A filament composed of a nano fiber can be utilized for artificial leather, filters, diapers, sanitary pads, sutures, anti-setting agents, wiping cloths, artificial vessels, bone fixing devices and the like, and in particular, it is very useful for the production of the artificial leather.

BACKGROUND ART

As conventional techniques for preparing an ultra fine fiber or nano fiber suitable for the production of artificial leather, there are known a sea-island type conjugated spinning method, a division type conjugated spinning method, a blend spinning method and so on.

However, in case of the sea-island type conjugated spinning method or the blend spinning method, one of two polymer components comprising a fiber must be dissolved and removed for making the ultra fine fiber. In order to produce artificial leather from the fiber prepared by these methods, a complex process must be carried out, including melt spinning, nano fiber production, non-woven fabric production, urethane impregnation and single component dissolution. Nevertheless, it has been impossible to produce a fiber with a diameter 1,000 nm or less by the above two methods.

In case of the spit type conjugate spinning method, it has been problematic in that since two polymer components (for example, polyester and polyamide) with different dyeing properties co-exist in a fiber, uneven dyeing occurs and an artificial leather production process is complicated. In addition, it has been difficult to produce a fiber with a diameter 2,000 nm or less by the above method.

As another conventional technique for preparing a nano fiber, an electrospinning method is suggested in U.S. Pat. No. 4,323,525.

In the electrospinning method, a polymer spinning dope in a spinning dope main tank is continuously and constantly fed into a plurality of nozzles, which has a high voltage applied, through a metering pump. Subsequently, the spinning dope fed to the nozzles is spun and collected through the nozzles on a collector of an endless belt type having a high voltage more than 5 kV, thereby producing a fiber web.

The conventional electrospinning method can produce only a web or non-woven fabric composed of a nano fiber 1,000 nm or less. Thus, it is difficult to prepare a continuous filament using the conventional electrospinning method. Hence, to prepare a continuous filament, the produced nano fiber web has to be cut to a predetermined length to produce a staple fiber and this staple fiber has to be blown and undergone an additional spinning process, which makes the process complicated.

A spinning distance (distance between the nozzle and the collector) is so short in an electrospinning process that a method capable of drawing by applying a physical force is restrictive, and thus the mechanical properties are very low.

Meanwhile, as a method for arranging nano fibers in a fiber axis direction when preparing a filament composed of nano fibers, it has been already explained that fibers are arranged between conductive lines by placing the conductive lines on both sides of a nonconductive material such as quartz and then performing electrospinning thereon [Dan Li, Yuliang Wang, and Younan Xia, Advanced Materials Vol 16(4), pp 361-366, 2004]. However, this method has a low possibility of industrialization, and any drawing force cannot be applied to this method.

Meanwhile, Korean Patent Application No. 2004-6402 discloses a process of preparing a filament composed of a nano fiber by preparing a ribbon-like nano fiber web by electrically spinning a nano fiber on a roller, twisting it while passing it through an air twisting machine, and then drawing it. However, this conventional process is problematic in that the strength of the prepared filament is low due to poor arrangement of nano fibers in the fiber axis direction.

As seen from above, there is a problem that it is not possible to mass-produce a continuous filament composed of a nano fiber which is superior in drawing properties due to poor arrangement of nano fibers in the fiber axis direction by the conventional techniques known so far.

DETAILED DESCRIPTION OF THE INVENTION

Technical Problems

The present invention is intended to mass-produce a continuous filament composed of a nano fiber which is superior in physical properties with a simple and continuous procedure by preparing an undrawn filament composed of a nano fiber which is superior in drawing properties using an electrospinning method, and then performing a drawing procedure. Additionally, the present invention is intended to provide a continuous filament of a nano fiber without any additional spinning process.

Additionally, the present invention is intended to provide a continuous filament of a nano fiber which is superior in physical properties and is suitable for various industrial materials, such as a filter, diaper, sanitary pad, artificial vessel and so on, as well as artificial leather.

Technical Solutions

To solve the above-described problems, there is provided a method of manufacturing a continuous filament by electrospinning method, wherein electrospun nano fibers 4 are collected on a collector 7 by electrically spinning a polymer spinning dope in a spinning dope main tank 1 onto the collector 7, which is a disk-shaped conductive material with a high voltage applied thereto and which rotates at a rotational linear velocity of 5 m/sec or more, through nozzles 2 having a high voltage applied thereto, and then the nano fiber 4 collected on the collector 7 are prepared in the form of a continuous filament by use of a collecting roller 11, and then the nano fibers 4 are (I) put in a canvas 14 through a traverse 13, or (II) dried, drawn, and wound consecutively.

Furthermore, the continuous filament of the present invention is prepared by the above method, has nano fibers of the continuous filament arranged at an angle of 10° or less in the axis direction of the continuous filament, and thus have a stress of 100 MPa or more.

Hereinafter, the present invention will be described in detail with reference to the accompanying drawings.

First, in the present invention, as shown in FIGS. 1 to 4, electrospun nano fibers 4 are collected on a collector 7 by electrically spinning a polymer spinning dope onto the collector 7, which is a disk-shaped conductive material with a high voltage applied thereto and which rotates at a rotational linear velocity of 5 m/sec or more, through nozzles 2 having a high voltage applied thereto.

FIGS. 1 to 4 are schematic process diagrams of the present invention.

If the rotational linear velocity of the collector is less than 5 m/sec, the nano fibers collected on the collector are not oriented well in the filament (fiber) axis direction, thus deteriorating the drawing properties of an undrawn filament, and accordingly, deteriorating the physical properties of a final product.

The nozzles 2 and the collector 7 are connected to a high voltage generator 3, and thus have a high voltage applied thereto.

The collector 7 may be of a single-layer structure consisting of one disk-shaped conductive material as shown in FIGS. 1 and 2, or a multi-layer structure consisting of two or more disk-shaped conductive materials as shown in FIGS. 3 and 4.

The multi-layer collector 7 has such a structure in which two or more disk-shaped conductive materials rotating at a rotational linear velocity of 5 m/sec or more on the same rotational axis are coupled in an integral or division type.

Additionally, a nonconductive separating plate 9 is installed between the disk-shaped conductive materials so that, at the time of spinning a polymer spinning dope onto the multi-layer collector 7, nano fibers are not scattered but effectively collected at lateral sides (h parts) of the respective disk-shaped conductive materials. A nonconductive plate 6 is attached to the top surface of the multi-layer collector 7.

The height (h of FIG. 6) of the disk-shaped conductive materials comprising the collector 7 is 1 to 100 mm, and more preferably, 5 to 60 mm.

If the height (h) of the disk-shaped conductive materials is less than 1 mm, it is difficult for electrospun nano fibers to be collected on the disk-shaped conductive materials. If the height (h) of the disk-shaped conductive materials exceeds 100 mm, the range of collection of the nano fibers is too wide, which makes it difficult to draw the nano fibers collected on the disk-shaped conductive materials in the form of a filament, and which causes the nano fibers not to be arranged well in the rotary direction of the disk-shaped conductive materials, thereby deteriorating the physical properties of the filament.

Additionally, it is preferable that the nonconductive plate 6 serving to cut off a current flow simultaneously while supporting the collector is attached to the top surface of the multi-layer collector 7, and a linear or rod-like conductive material 5 is installed in the outer circumferential direction from the center point of the disk-shaped conductive materials comprising the multi-layer collector 7 in order to improve the orientation of the nano fibers.

Additionally, it is preferable that the nonconductive plate 6 serving to cut off a current flow simultaneously while supporting the collector is attached to the top surface of the multi-layer collector 7, and a linear or rod-like conductive material 5 is installed in the outer circumferential direction from the center point of the multi-layer collector 7 in order to improve the orientation of the nano fibers.

The nonconductive material 6 is made of polypropylene, polyethylene, Teflon, or a polymer which is a mixture thereof.

The collector 7 rotates by being connected to a rotary motor 10 by connecting rods 8 and 9.

The polymer spinning dope includes polyester resin, nylon resin, polysulfone resin, polylactic acid, chitosan, collagen, cellulose, fibrinogen, a copolymer thereof, a mixture thereof, or a sol-gel containing a metal component.

The gist of the present invention is to prepare a filament composed of nano fibers having superior mechanical properties by improving the drawing properties of an undrawn filament by arranging electrospun nano fibers in the fiber axis direction using the centrifugal force of the collector, which is a rotary body rotating at a high velocity.

Generally, it is difficult for the nonwoven fabric or filament prepared by electrospinning to have a system capable of applying a physical force during an electrospinning process. Because the distance between the nozzles and the collector is 30 cm or less, which is very slight, it is very difficult to apply a mechanical force to a narrow space. Hence, the only method of applying a drawing force is to use air or a centrifugal force.

In the present invention, nano fibers are arranged side by side on the collector 7 by electrically spinning a polymer spinning dope onto the collector 7 rotating at a high velocity, thereby preparing a filament having superior physical properties.

As for a fiber prepared by electrospinning, it is a general phenomenon that crystallization is performed to a considerable extent. Hence, it is very difficult to increase the physical properties through a separate drawing process. The reason of which is because the drawing properties are substantially deteriorated due to formed crystalline. Therefore, the only method of suppressing crystalline formation during an electrospinning procedure is to collect nano fibers prepared by electrospinning on a collector 7, which is a rotary body rotating at a high velocity, within a very short time. If the rotational linear velocity of the collector is low, it is impossible to suppress crystalline formation. As there occurs a phenomenon that fibers are arranged side by side in the rotary direction of the collector 7, these fibers are collected to thus consecutively prepare a filament. The filament thus-prepared has superior drawing properties because it has a crystallinity of the undrawn yarn level. If necessary, a filament composed of nano fibers having superior mechanical properties can be prepared by performing drawing using a difference in the linear velocity of a roller.

Meanwhile, the nozzles 2 are arranged along the circumferential direction of the collector 7 as shown in FIG. 5.

FIG. 5 is a plane view of the portion where nozzles are arranged in FIG. 1.

Additionally, as shown in FIG. 6, the angle (θ) between the collector 7, which is a disk-shaped conductive material, and the nozzles 2 is no more than 90° in the longitudinal direction, i.e., +90 to −90°, and more preferably, no more than 85° in the longitudinal direction, i.e., +85 to −85°.

If the angle exceeds +90°, it is difficult to electrically spin nano fibers onto the rotating collector 7. If the angle is less than −90°, the spun nano fibers are not collected well on the collector 7, which may increase scattered nano fibers.

As shown in FIG. 6, the nozzles 2 may be arranged longitudinally in two or more rows at a different angle (θ).

FIG. 6 is a side view of the collector and the nozzles showing the nozzles 2 being arranged longitudinally on the collector in three rows at a different angle (θ).

Furthermore, in the present invention, there is included a method for preparing a hybrid filament by electrically spinning two or more types of polymer spinning dopes to respective nozzles arranged longitudinally in two or more rows.

The nozzles 2 may be of a dual core-shell structure or a triple or more core-shell structure.

The number of the nozzles 2 is one or more, and more preferably, 100 or more.

When electrically spinning a polymer spinning dope onto the disk-shaped collector 7 which is rotating, it is more preferable to feed a nano fiber isolating solution to the collector 7.

The nano fiber isolating solution is one or two or more layers of mixtures selected from water, an organic solvent, surfactant, and silicon oil.

Next, as shown in FIGS. 1 to 4, the nano fibers collected on the collector 7 are prepared in the form of a continuous filament by use of a collecting roller 11, and then they are (I) put in a canvas 14 through a traverse 13 as shown in FIG. 1, or (II) dried, drawn, and wound consecutively, thereby preparing a continuous filament composed of nano fibers.

The method as in FIG. 1 is proper for when it is difficult to perform continuous drawing because the rotational linear velocity of the collector 7 is too fast, while the method as in FIG. 2 is suitable for when the degree of elongation of a nano fiber undrawn filament is high because of the material.

In case of separate type drawing as in FIG. 2, the nano fibers collected on the collector 7 are drawn in the form of a continuous undrawn filament by the collecting roller 11, unvaporized solvents are vaporized while passing through a drier 15, and then the nano fibers are firstly drawn between a first drawing roller 16 and a second drawing roller 17.

At this time, the first drawing roller 16 may be heated if necessary.

Continuously, the first drawn filament is secondly drawn between the second drawing roller 17 and a third drawing roller 19, and thereafter wound on a winding machine 20, thereby preparing a continuous filament composed of a nano fiber.

At this time, thermosetting may be carried by installing a heater 18 within the second drawing section, or the drawing procedure may be performed in three or more stages.

It is possible that nano fiber filaments having a different component may be prepared, respectively, by electrically spinning different polymer spinning dopes onto the disk-shaped conductive materials comprising the multi-layer collector 7, and thereafter, as shown in FIG. 4, they may be doubled in the collecting roller 11, thereby easily preparing a hybrid filament.

Additionally, in the present invention, it is also possible that nano fiber filaments having a different thickness may be prepared, respectively, by differentiating the height (h) of the disk-shaped conductive materials comprising the multi-layer collector 7, and thereafter they may be doubled in the collecting roller 11.

At this time, if different polymer spinning dopes are electrically spun onto the respective disk-shaped conductive materials, nano fiber filaments having a different thickness and a different component may be prepared, respectively, and if necessary, they may be doubled by the collecting roller 11.

The continuous filament of the present invention prepared in the above-described process according to the present invention shows a stress of 100 MPa or more because nano fibers of the continuous filament are arranged at an angle of 10° or less in the axis direction of the continuous filament, and shows a necking stress or a partial/complete stretched stress-strain curve on a stress-strain graph.

It is more preferable that the nano fibers of the filament are arranged at an angle of 5° or less in the axis direction of the continuous filament.

The continuous filament of the present invention may have a hollow shape or have pores formed on the surfaces.

Particularly, the continuous filament of the present invention is very superior in physical properties because it is drawn well.

ADVANTAGEOUS EFFECTS

The present invention is very superior in terms of physical properties because the continuous filament is composed of an aggregate of well-arranged nano fibers. The continuous filament prepared in the present invention is greatly improved in terms of physical properties.

Figure 1:
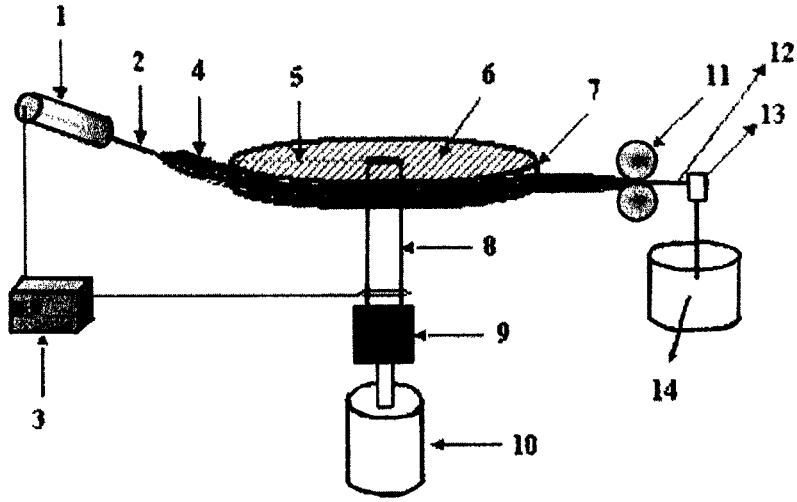
FIGS. 1 to 4 are schematic views of a process of preparing a continuous filament according to the present invention.
Figure 2:
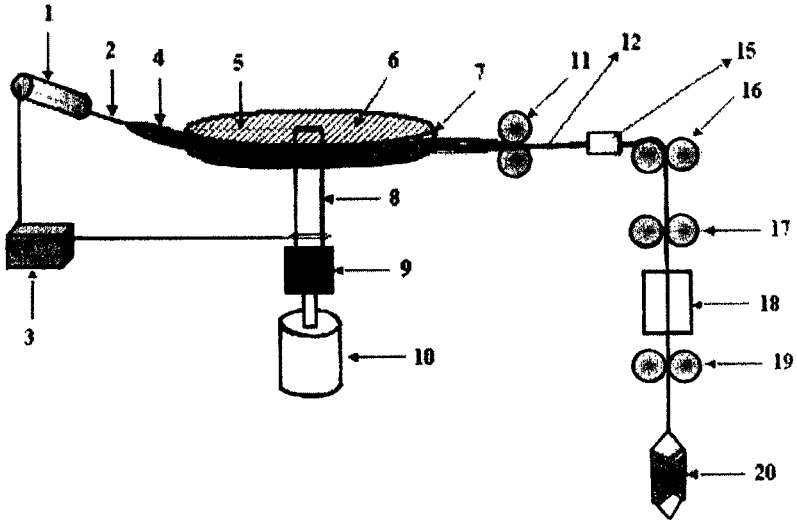

Explanation of Reference Numerals for the Major Parts in the Drawings

1: polymer spinning dope main tank
2: nozzle
3: high voltage generator

-continued

| Explanation of Reference Numerals for the Major Parts in the Drawings | |
|---|---|
| 4: | electrospun nano fiber |
| 5: | linear or rod-like conductive material |
| 6: | nonconductive plate |
| 7: | collector (disk-shaped conductive material) |
| 8: | nonconductive connecting rod |
| 9: | insulating connecting rod |
| 10: | rotary motor |
| 11: | collecting roller |
| 12: | filament |
| 13: | traverse |
| 14: | canvas |
| 15: | drier |
| 16: | first drawing roller |
| 17: | second drawing roller |
| 18: | heater |
| 19: | third drawing roller |
| 20: | winding machine |
| h: | height of collector which is a disk-shaped conductive material |
| θ: | angle between nozzles and central axis of collector |
| A, B, C: | type of polymer |

BEST MODE FOR CARRYING OUT THE INVENTION

The present invention is now understood more concretely by comparison between examples of the present invention and comparative examples. However, the claims of the present invention are not limited to such examples.

Example 1

A polymer spinning dope was prepared by dissolving nylon 6 resin, which has a relative viscosity of 3.2 in a 96% sulfuric acid solution, in formic acid at a concentration of 15% by weight. The polymer spinning dope had a surface tension of 49 mN/m, a solution viscosity of 40 centipoise at an ambient temperature, and an electrical conductivity of 420 mS/m.

The prepared spinning dope was electrically spun onto a collector 7, which is a disk-shaped stainless steel plate having a high voltage applied thereto and rotating at a rotational linear velocity of 20 m/sec, through nozzles 2 with a high voltage applied thereto in the electrospinning method as shown in FIG. 1, thereby collecting electrospun nano fibers 4 on the collector 7.

The collector rotates by being connected to a rotary motor 10 by connecting rods 8 and 9, and has a diameter of 1.5 m. The height (h) of the collector is 25 mm.

The total number of the nozzles 2 is 900. They are arranged in 300 matrices in the outer circumference of the collector, and three rows of three nozzles having an angle (θ) of 70°, 0°, and −70°, respectively, relative to the central axis of the collector are arranged longitudinally in each matrix. The diameter of the nozzles was 1 mm, and the voltage thereof was 35 kV.

At the time of electrospinning, water (nano fiber separating solution) was fed onto the collector.

Next, the nano fibers collected on the collector 7 were collected by collecting roller 11 having a surface velocity of 20 m/min, to prepare a continuous filament 12, and it was put in a canvas 14 through a traverse 13 moving at regular intervals.

As a result of evaluating the physical properties of the prepared continuous filament, the strength was 170 MPa, the degree of elongation was 25%, and the nano fibers were arranged at an arrangement angle of 1.6° in the axis direction of the filament.

Figure 7:
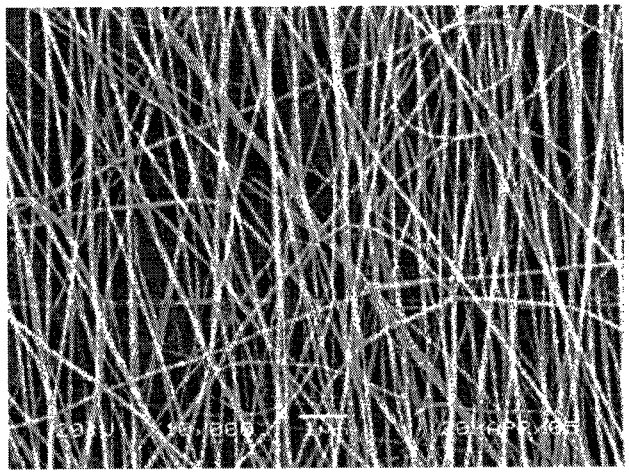
FIG. 7 is an electron micrograph of the surface of the continuous filament prepared by Example 1.
Figure 9:
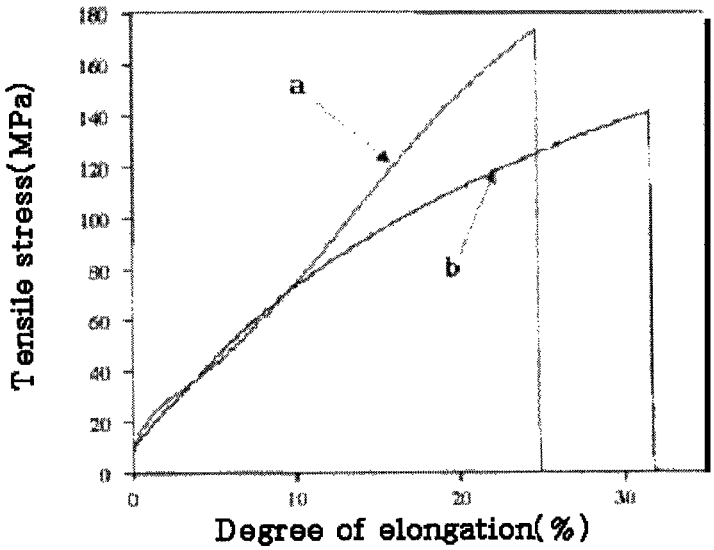
FIG. 9 is stress-strain curve graphs of the continuous filaments prepared by Examples 1 and 2 (in which a is a stress-strain curve graph of the continuous filament prepared by Example 1, and b is a stress-strain curve graph of the continuous filament prepared by Example 2)

FIG. 7 is an electron micrograph of the surface of the prepared continuous filament. A stress-strain curve graph of the prepared continuous filament was as shown in a of FIG. 9.

Example 2

A continuous filament was prepared under the same procedure and conditions as in Example 1 except that the rotational linear velocity of the collector 7 and the surface velocity of the collecting roller 11 were changed to 10 m/sec, respectively. As a result of evaluating the physical properties of the prepared continuous filament, the strength was 140 MPa, the degree of elongation was 32%, and the nano fibers were arranged at an arrangement angle of 2.8° in the axis direction of the filament.

Figure 8:
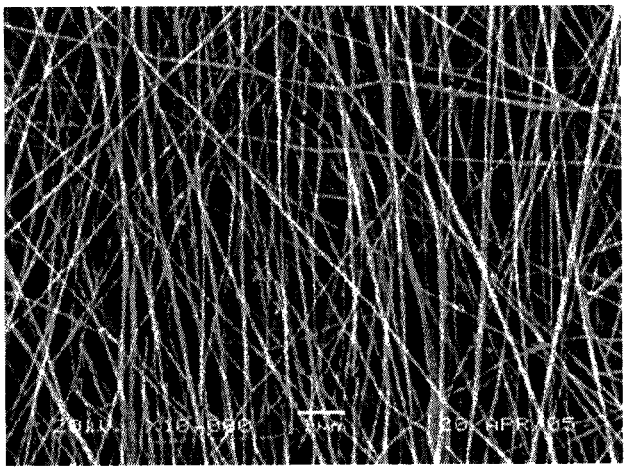
FIG. 8 is an electron micrograph of the surface of the continuous mat prepared by Example 2.

FIG. 8 is an electron micrograph of the surface of the prepared continuous filament. A stress-strain curve graph of the prepared continuous filament was as shown in b of FIG. 9.

Example 3

A polymer spinning dope was prepared by dissolving a poly(ϵ-caprolactone) polymer (purchased from Aldrich Chemical Company) having a number average molecular weight of 80,000 in a mixed solvent of methylene chloride/N,N'-dimethyl form amide (volume ratio: 75/25) at a concentration of 13% by weight. The polymer spinning dope had a surface tension of 35 mN/m, a solution viscosity of 250 centipoise at an ambient temperature, an electrical conductivity of 0.02 mS/m and a permittivity constant of 90.

The prepared spinning dope was electrically spun onto a collector 7, which is a disk-shaped stainless steel plate having a high voltage applied thereto and rotating at a rotational linear velocity of 10 m/sec, through nozzles 2 with a high voltage applied thereto in the electrospinning method as shown in FIG. 1, thereby collecting electrospun nano fibers 4 on the collector 7.

The collector rotates by being connected to a rotary motor 10 by connecting rods 8 and 9, and has a diameter of 2 m. The height (h) of the collector is 30 mm.

The total number of the nozzles 2 is 800. They are arranged in 400 matrices in the outer circumference of the collector, and two rows of two nozzles having an angle (θ) of 70° and −70°, respectively, relative to the central axis of the collector are arranged longitudinally in each matrix. The diameter of the nozzles was 1 mm, and the voltage thereof was 35 kV.

At the time of electrospinning, water (nano fiber separating solution) was supplied to the collector.

Figure 10:
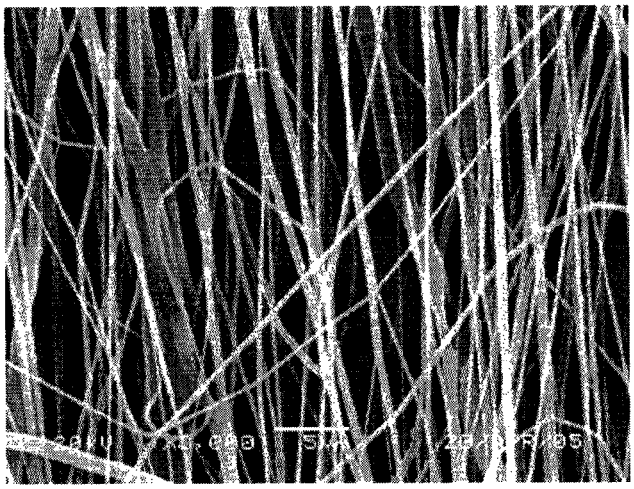
FIG. 10 is an electron micrograph of the surface of the continuous filament prepared by Example 3.

Next, the nano fibers collected on the collector 7 were collected by collecting roller 11 having a surface velocity of 10 m/sec, to prepare a continuous filament, and it was put in a canvas 14 through a traverse 13 moving at regular intervals. As a result of evaluating the physical properties of the prepared continuous filament, the strength was 105 MPa, the degree of elongation was 75%, and the nano fibers were arranged at an arrangement angle of 1.8° in the axis direction of the filament. FIG. 10 is an electron micrograph of the surface of the prepared continuous filament. A stress-strain curve graph of the prepared continuous filament was as shown in c of FIG. 15. In addition, an X-ray wide angle graph of the continuous filament prepared is as shown in c of FIG. 14. An X-ray wide angle graph of the continuous filament prepared when the collector is not rotated is as shown in a of FIG. 14. In this case, crystalline is well-developed.

Example 4

A continuous filament was prepared under the same procedure and conditions as in Example 3 except that the rotational linear velocity of the collector was changed to 20 m/sec, respectively. An X-ray wide angle graph of the prepared continuous filament is as shown in d of FIG. 14.

Figure 14:
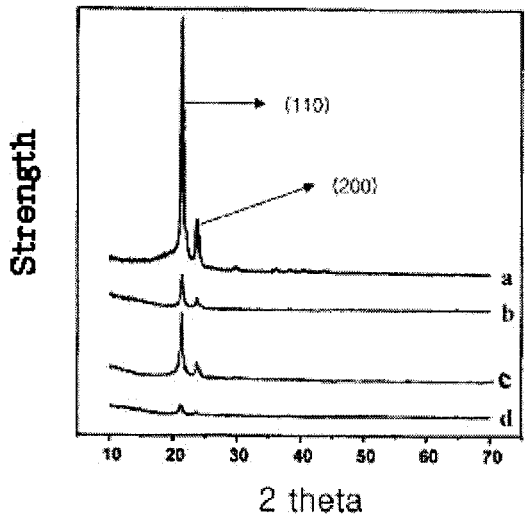
FIG. 14 is X-ray wide angle graphs of the continuous filament depending on a change in the rotational linear velocity of the collector (in which graph a is an X-ray wide angle graph of the continuous filament prepared when the collector is not rotated, graph b is an X-ray wide angle graph of the continuous filament prepared by Comparative Example 1, graph c is an X-ray wide angle graph of the continuous filament prepared by Example 3, and graph d is an X-ray wide angle graph of the continuous filament prepared by Example 4)

The visibility of crystalline formation was very low in the continuous filament prepared as shown in the X-ray wide angle (d of FIG. 14).

Example 5

A polymer spinning dope was prepared by dissolving nylon 66 resin, which has a relative viscosity of 3.0 in a 96% sulfuric acid solution, in a mixed solvent of formic acid/acetic acid (volume ratio: 70/30) at a concentration of 15% by weight. The polymer spinning dope had a surface tension of 37 mN/m, a solution viscosity of 420 centipoise at an ambient temperature, and an electrical conductivity of 340 mS/m.

Figure 3:
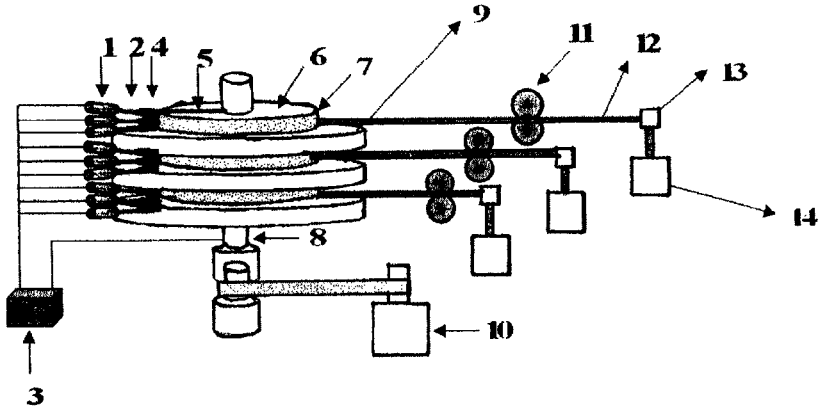
Figure 4:
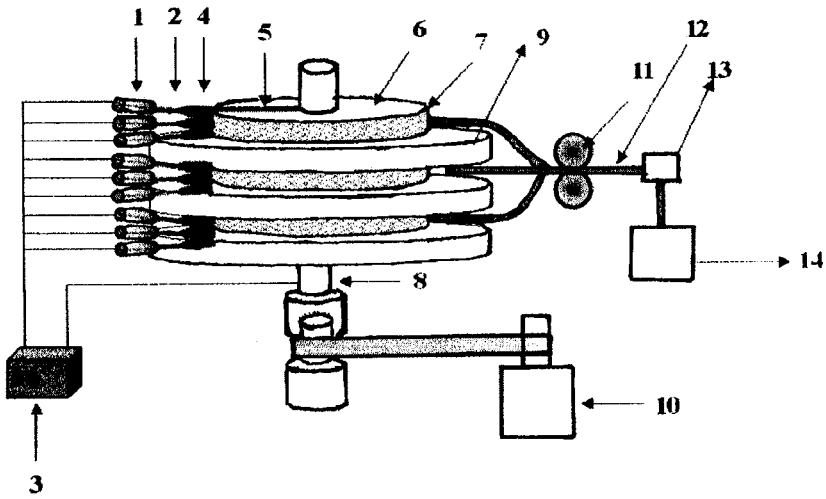
Figure 5:
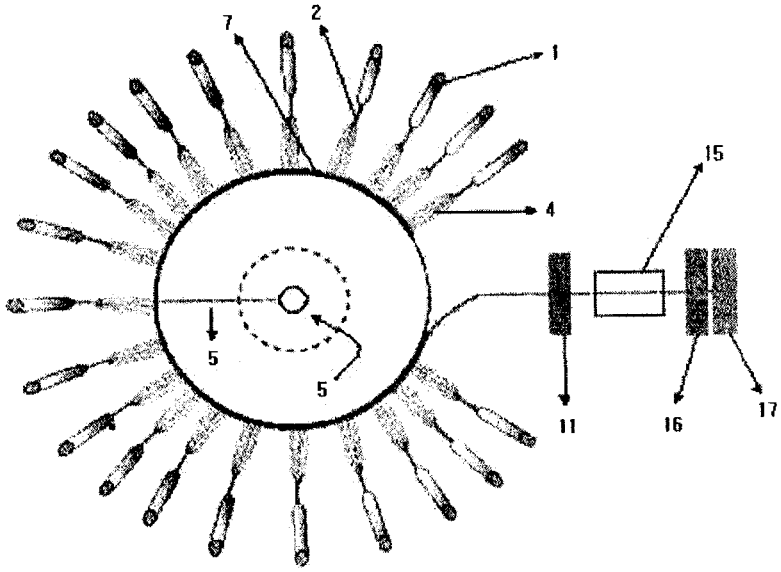
FIG. 5 is a plane view of the portion where nozzles are arranged along the circumferential direction of a collector of FIG. 1.
Figure 6:
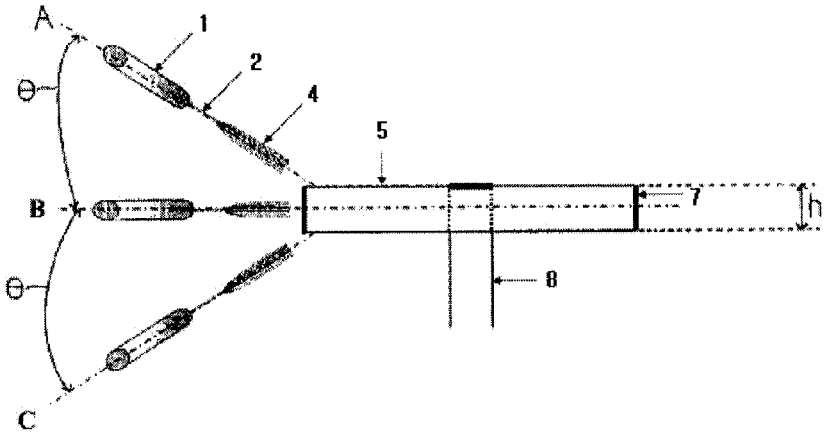
FIG. 6 is a side view of the collector and the nozzles showing three nozzles, each having a different angle θ relative to the horizontal axis of the collector, being arranged longitudinally in three rows.

The prepared spinning dope was electrically spun onto a 8-layered collector 7, which consists of 8 disk-shaped conductive materials (stainless steel plates) having a high voltage applied thereto and rotating at a rotational linear velocity of 20 m/sec on the same rotational axis, through nozzles 2 with a high voltage applied thereto in the electrospinning method as shown in FIG. 3, thereby collecting electrospun nano fibers 4 on the disk-shaped conductive materials comprising the collector 7. A round dividing plate 9 made of polypropylene, which is a nonconductive material, was installed between the disk-shaped conductive materials. The collector rotates by being connected to a rotary motor 10 by a connecting rod 8, and has a diameter of 1.2 m. The height (h) of the disk-shaped conductive materials comprising the collector is 20 mm. The nozzles allocated to each layer were arranged in three rows in each layer using a round nozzle block. The total number of the nozzles 2 for each layer is 900. They are arranged in 300 matrices in the outer circumference of the collector, and three rows of three nozzles having an angle (θ) of 65°, 0°, and −65°, respectively, relative to the central axis of the disk-shaped conductive materials comprising the collector 7 are arranged longitudinally in each matrix. The total number of the nozzles used for the spinning apparatus of the present invention consisting of 8 layers is 7,200. The diameter of the nozzles was 1 mm, and the voltage thereof was 35 kV, and the spinning distance thereof was 12 cm.

At the time of electrospinning, water (nano fiber separating solution) was supplied to the collector.

Figure 11:
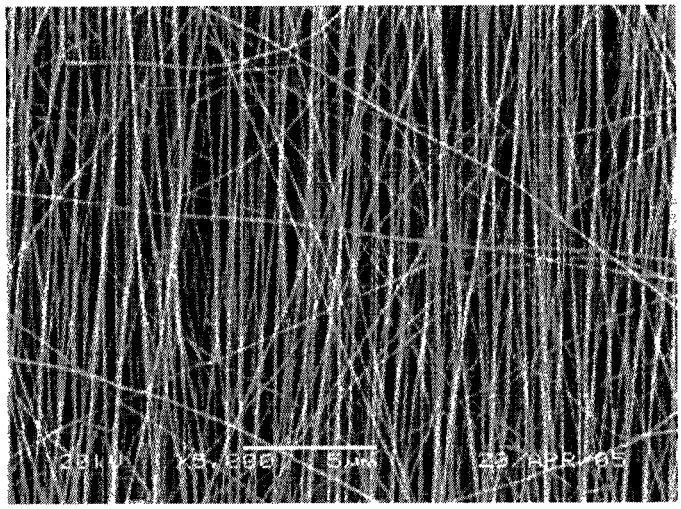
FIG. 11 is an electron micrograph of the surface of the continuous mat prepared by Example 5.

Next, the nano fibers collected on the collector 7 were collected by collecting roller 11 having a surface velocity of 900 m/min, to prepare a continuous filament, and it was put in 8 separate canvases 14 through a traverse 13 moving at regular intervals. The stress of the prepared filament was 165 MPa, and the degree of elongation thereof was 26%. A result obtained by taking an electron micrograph of the surface of the nano fibers is as shown in FIG. 11, and the arrangement angle relative to the fiber axis was 1.2°.

Example 6

A polymer spinning dope was prepared by dissolving nylon 6 resin, which has a relative viscosity of 3.2 in a 96% sulfuric acid solution, in formic acid at a concentration of 15% by weight. The polymer spinning dope had a surface tension of 50 mN/m, a solution viscosity of 540 centipoise at an ambient temperature, and an electrical conductivity of 430 mS/m.

The prepared spinning dope was electrically spun onto a 8-layered collector 7, which consists of 8 disk-shaped conductive materials (stainless steel plates) having a high voltage applied thereto and rotating at a rotational linear velocity of 20 m/sec on the same rotational axis, through nozzles 2 with a high voltage applied thereto in the electrospinning method as shown in FIG. 3, thereby collecting electrospun nano fibers 4 on the disk-shaped conductive materials comprising the collector 7. A round dividing plate 9 made of polypropylene, which is a nonconductive material, was installed between the disk-shaped conductive materials. The collector rotates by being connected to a rotary motor 10 by a connecting rod 8, and has a diameter of 1.2 m. The height (h) of the disk-shaped conductive materials comprising the collector is 20 mm. The nozzles allocated to each layer were arranged in three rows in each layer using a round nozzle block. The total number of the nozzles 2 for each layer is 900. They are arranged in 300 matrices in the outer circumference of the collector, and three rows of three nozzles having an angle (θ) of 65°, 0°, and 65°, respectively, relative to the central axis of the disk-shaped conductive materials comprising the collector are arranged longitudinally in each matrix. The total number of the nozzles used for the spinning apparatus of the present invention consisting of 8 layers is 7,200. The diameter of the nozzles was 1 mm, and the voltage thereof was 35 kV, and the spinning distance thereof was 12 cm.

At the time of electrospinning, water (nano fiber separating solution) was supplied to the collector.

Figure 12:
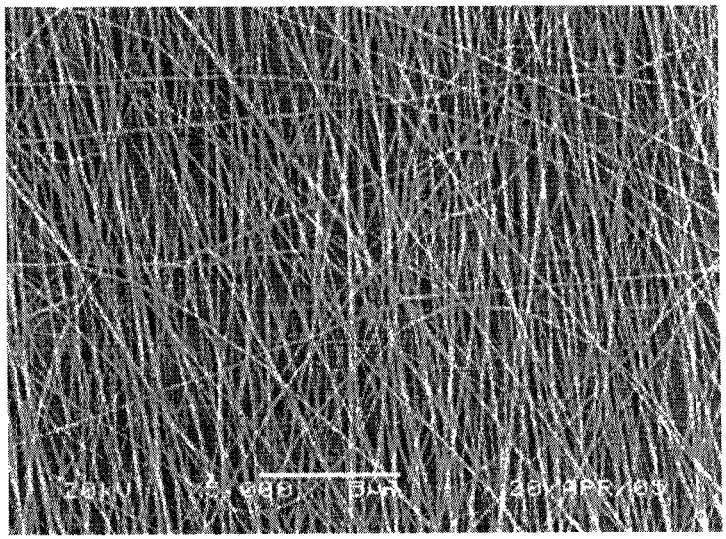
FIG. 12 is an electron micrograph of the surface of the continuous mat prepared by Example 6.

Next, the nano fibers collected on the collector 7 were collected by collecting roller 11 having a surface velocity of 720 m/min, to prepare a continuous filament 12, and it was put in 8 separate canvases 14 through a traverse 13 moving at regular intervals. The stress of the prepared filament was 173 MPa, and the degree of elongation thereof was 29%. A result obtained by taking an electron micrograph of the surface of the nano fibers is as shown in FIG. 12, and the arrangement angle relative to the fiber axis was 1.3°.

Comparative Example 1

Figure 13:
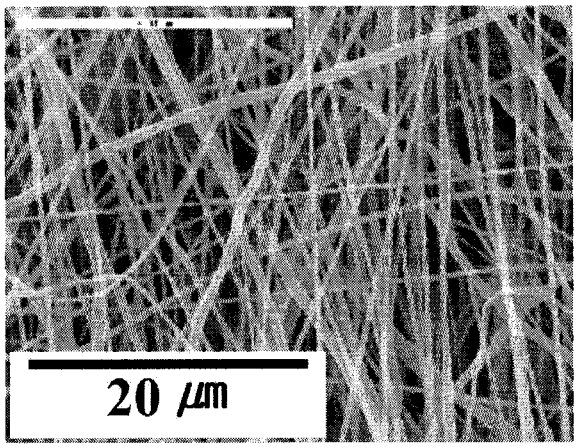
FIG. 13 is an electron micrograph of the surface of the continuous mat prepared by Comparative Example 1.

A continuous filament was prepared under the same procedure and conditions as in Example 3 except that the rotational linear velocity of the collector was changed to 3 m/sec, respectively. An electron micrograph of the surface of the prepared filament is as shown in FIG. 13, and the angle at which the nano fibers were arranged in the filament axis direction was 15°.

An X-ray wide angle graph of the prepared continuous filament is as shown in b of FIG. 14.

It can be seen that crystalline formation is very prominent in the prepared continuous filament as shown in the X-ray wide angle graph (b of FIG. 14).

Figure 15:
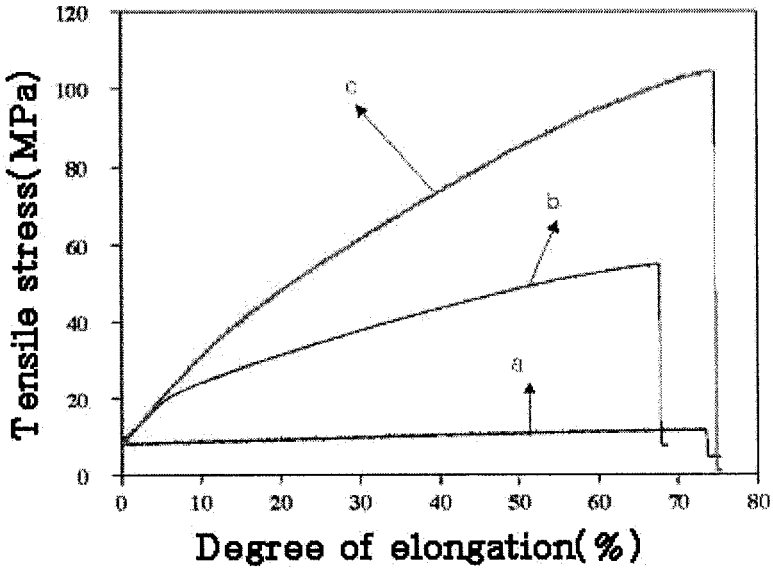
FIG. 15 is stress-strain graphs of the filament prepared according to the rotational velocity of the collector (in which graph a is a stress-strain graph of the continuous filament prepared when the collector is not rotated, graph b is a stress-strain graph of the continuous filament prepared by Comparative Example 1, and graph c is a stress-strain graph of the continuous filament prepared by Example 3.

The stress of the prepared continuous filament was 53 MPa, the degree of elongation thereof was 68%, and the stress-strain curve graph thereof was as shown in b of FIG. 15.

INDUSTRIAL APPLICABILITY

The continuous filament prepared in the present invention is useful as materials for various industrial fields, such as an artificial dialyzing filter, artificial vessel, anti-adhesion agent, artificial bone and so on, as well as daily necessities, such as artificial leather, air cleaning filters, wiping cloths, golf gloves, wigs and so on.

What is claimed is:

1. A method of manufacturing a continuous filament by an electrospinning method, wherein electrospun nano fibers are collected on a multi-layer type collector consisting of two or more, rotating disk-shaped conductive materials by electrically spinning a polymer spinning dope in a spinning dope main tank onto the multi-layer type collector with a high voltage applied thereto and which rotates at a rotational linear velocity of 5 m/sec or more, through nozzles having a high voltage applied thereto, and collecting the nano fibers 4 on the collector in the form of a continuous filament by the use of a collecting roller and conveying the nano fibers to a canvas through a traverse or dried, drawn, and wound consecutively.

2. The method of claim 1, wherein the height (h) of each of the multi-layer type collectors is 1 to 100 mm.

3. The method of claim 1, wherein the height (h) of each of the multi-layer type collectors is 5 to 60 mm.

4. The method of claim 1, wherein the angle (θ) between the horizontal axis of each of the multi-layer type collectors and each of the nozzles is no more than 90° in the longitudinal direction.

5. The method of claim 1, wherein the angle (θ) between the horizontal axis of each of the multi-layer type collectors and each of the nozzles is no more than 85° in the longitudinal direction.

6. The method of claim 1, wherein the nozzles are of a dual core-shell structure or a triple or more core-shell structure.

7. The method of claim 1, wherein a nonconductive plate is attached to the top surface of each of the multi-layer type collectors.

8. The method of claim 1, wherein a linear or rod-like conductive material is installed in the outer circumferential direction from the center point of each of the multi-layer type collectors.

9. The method of claim 1, wherein each of the nozzles are arranged longitudinally in two or more rows so that the nozzles have a different angle (θ) relative to the horizontal axis of the corresponding multi-layer type collector.

10. The method of claim 9, wherein two or more types of polymer spinning dopes are electrically spun through different nozzles arranged longitudinally in said two or more rows.

11. The method of claim 1, wherein the polymer spinning dope includes a polyester resin, a nylon resin, a polysulfone resin, a polylactic acid, chitosan, collagen, cellulose, fibrinogen, a copolymer thereof, a mixture thereof, or a sol-gel containing a metal component.

12. The method of claim 1, wherein a nano fiber separating solution is fed onto the multi-layer type collectors.

13. The method of claim 12, wherein the nano fiber separating solution is one or two or more types of mixtures selected from water, an organic solvent, a surfactant, and silicon oil.

14. The method of claim 1, wherein the number of the nozzles is one or more.

15. The method of claim 1, wherein the number of the nozzles is 100 or more.

16. The method of claim 1, wherein the prepared continuous filaments are doubled and put in one canvas through a traverse.

17. The method of claim 1, wherein the prepared continuous filaments are doubled and then dried, drawn, and wound.

18. The method of claim 1, wherein the multi-layer type collector is an integral or division type.

19. The method of claim 1, wherein a nonconductive dividing plate is installed between the disk-shaped conductive materials comprising the multi-layer collector.

20. The method of claim 1, wherein the height (h) of the disk-shaped conductive materials comprising each of the multi-layer layer collectors is different from each other.

21. The method of claim 1, wherein different polymer spinning dopes are electrically spun onto the disk-shaped conductive materials of the multi-layer type collector, respectively.

22. A method of manufacturing a continuous filament of nano fibers by electrospinning which comprises:

electrically spinning a polymer spinning dope through nozzles onto a multi-layer type disk-shaped collector made of conductive material, said nozzles and said multi-disk type collector having a high voltage applied thereto and said multi-disk type collector rotating at a rotational linear velocity of 5 m/sec or more, and collecting the nano-fibers on side faces of the multi-disk type collector in the form of undrawn continuous, axially oriented nano fiber filaments.

23. The method of claim 22, wherein the axially oriented nano fiber filaments collected from said multi-layer type, disk-shaped collector are integrally or divisionally coupled.

24. The method of claim 23, wherein a conductive material extends from the center of the disk-shaped conductive material to the outer circumference thereof to facilitate the axial orientation of the nano fibers.

25. The method of claim 22 wherein the nano fiber filaments are drawn.

* * * * *